US012527390B2

(12) United States Patent
Howell et al.

(10) Patent No.: US 12,527,390 B2
(45) Date of Patent: Jan. 20, 2026

(54) ARCH PACK FRAME AND SUSPENSION SYSTEM

(71) Applicant: Here Be Dragons, LLC, Bridgton, ME (US)

(72) Inventors: Frank A. Howell, Sweden, ME (US); Justin A. Kiger, Windham, ME (US)

(73) Assignee: Here Be Dragons, LLC, Bridgton, ME (US)

( * ) Notice: Subject to any disclaimer, the term of this patent is extended or adjusted under 35 U.S.C. 154(b) by 165 days.

(21) Appl. No.: 18/524,253

(22) Filed: Nov. 30, 2023

(65) Prior Publication Data

US 2025/0009111 A1 Jan. 9, 2025

Related U.S. Application Data

(60) Provisional application No. 63/525,402, filed on Jul. 7, 2023.

(51) Int. Cl.
*A45F 3/08* (2006.01)
*A45F 3/04* (2006.01)

(52) U.S. Cl.
CPC ..... *A45F 3/08* (2013.01); *A45F 2003/045* (2013.01)

(58) Field of Classification Search
CPC ..... A45F 3/08; A45F 2003/045
See application file for complete search history.

(56) References Cited

U.S. PATENT DOCUMENTS 2,421,244 A 5/1947 Diaber
D224,631 S * 8/1972 Morris ..... D3/216
3,938,718 A * 2/1976 Madison ..... A45F 3/10 24/265 AL
4,356,942 A 11/1982 Hays
4,676,418 A * 6/1987 Lowe ..... A45F 3/047 224/262
4,911,346 A 3/1990 Shallman
4,934,573 A * 6/1990 Jaeger ..... A45F 3/08 224/628
5,366,126 A * 11/1994 Dausien ..... A45F 3/04 224/630
5,503,314 A 4/1996 Fiscus
5,553,759 A * 9/1996 McMaster ..... A45F 3/08 224/264
5,564,612 A * 10/1996 Gregory ..... A45F 3/08 224/633
5,725,139 A * 3/1998 Smith ..... A45F 3/02 224/637
6,276,584 B1 * 8/2001 McLachlan ..... A45F 3/08 224/633
6,321,959 B1 * 11/2001 Howell ..... A45F 3/047 224/262
6,536,641 B1 * 3/2003 Sundara ..... A47C 1/14 224/641

(Continued)

FOREIGN PATENT DOCUMENTS

EP 0567173 A1 10/1993

*Primary Examiner* — Nathan J Newhouse
*Assistant Examiner* — Lester L Vanterpool
(74) *Attorney, Agent, or Firm* — Gesmer Updegrove LLP

(57) ABSTRACT

A novel backpack frame having a pair of top end segments, a pair of stabilizing paddles, and a pair of vertical support members are disclosed. Also disclosed is a novel waist belt base and a removable waist belt that may be used with the backpack frame.

25 Claims, 10 Drawing Sheets

(56) References Cited

U.S. PATENT DOCUMENTS

| | | | | |
|---|---|---|---|---|
| 6,857,820 | B2 * | 2/2005 | Jacoway | B63C 11/02 405/187 |
| 6,892,915 | B2 * | 5/2005 | Mares | A45F 3/20 224/630 |
| 7,644,847 | B2 | 1/2010 | Howell | |
| 7,793,809 | B2 * | 9/2010 | Howell | A45F 3/10 224/628 |
| 8,556,147 | B2 * | 10/2013 | Howell | A45F 3/08 224/633 |
| 8,740,028 | B2 * | 6/2014 | Hairston | A45F 3/10 224/636 |
| 9,095,203 | B2 * | 8/2015 | Hairston | A45C 13/04 |
| 9,636,875 | B2 * | 5/2017 | Hairston | A45F 3/047 |
| 10,463,137 | B2 * | 11/2019 | Simione | A45F 3/08 |
| 11,311,062 | B2 * | 4/2022 | Roque | A41D 13/0562 |
| 11,849,830 | B2 * | 12/2023 | Howell | A45F 3/04 |
| 2006/0163305 | A1 * | 7/2006 | Tong | A45F 3/08 224/628 |
| 2006/0208024 | A1 * | 9/2006 | Gleason, Jr. | A45F 3/08 224/636 |
| 2007/0000964 | A1 * | 1/2007 | Howell | A45F 3/00 224/637 |
| 2018/0228271 | A1 * | 8/2018 | Rasmussen | A45F 3/08 |

* cited by examiner

ARCH PACK FRAME AND SUSPENSION SYSTEM

RELATED APPLICATION

This application claims the benefit of provisional application 63/525,402 filed Jul. 7, 2023.

BACKGROUND OF THE INVENTION

Field of Invention

The present invention relates generally to backpacks intended to carry heavy loads and more specifically, to those of greater volumes.

Discussion of Related Art

Backpacks (rucks) have been used by soldiers for thousands of years to carry everything they need for sustainment on or near the battlefield. Even with the availability of combat vehicles, the modern battlefield is no different.

Most recently, the war in Ukraine has reminded armies of the need for infantry to dismount and hide from satellites and drones as they maneuver. The equipment and supplies that they must carry while doing this often surpass 100 lbs. Thus, there is a critical need for backpacks that are more ergonomic, and more compatible with other gear worn on the back, such as body armor, all while being more capable of accommodating a greater range of human body sizes and shapes.

Prior art backpacks used for this purpose are primarily known as "existence rucks" and typically rely on a ridged or semi-rigid internal or external supporting frame with attached shoulder straps and a waist belt. Prior art backpacks utilize rigid or semi-rigid frames and utilize a permanently attached waist belt that relies on the latitudinal integrity of the frame to support and stabilize the belt as loads are carried.

Typically, stanchions are utilized at the base of the frame to support mounting points for each end of the belt. Some embodiments of this arrangement tension the waist belt across these stanchions to create a "director's chair" effect that keeps the belt from bottoming out against the inside of the supporting frame when loaded. The advantage of this arrangement is that the pressure against the wearer's lower back is evenly distributed along the length of the waist belt.

However, in such prior art backpacks, under heavy loading, the tensioned waist belt is free to twist as the backpack is driven downward by forces imparted by the carried load. The bottom edge of the belt tends to roll under itself, bunch, and gouge at the wearer's lower back.

Combatants on the modern battlefield must efficiently carry a wide variety of equipment that must be quickly employed. Devices carried at the waist force the soldier to choose between attaching them to the backpack's waist belt and losing them when the backpack is discarded, often in a dangerous situation when that equipment could be urgently needed. Alternatively, the soldier could opt to carry a separate belt that adds weight and conflicts with comfortably utilizing the backpack's waist belt.

Backpacks used by the military must accommodate body armor and hydration reservoirs worn on the back. Heavy loads carried under these demanding circumstances must be stabilized to improve balance while keeping the center of gravity of the carried load as close to the soldier's center of mass as possible. This is vital to facilitate a more erect/upright posture to minimize fatigue and improve situational awareness.

Whatever the precise merits, features, and advantages of the above-cited prior art, none of them achieves or fulfills the purposes of the present invention.

SUMMARY OF THE INVENTION

In one embodiment, the present invention provides a backpack frame for use with a backpack, the backpack frame having a backpack frame concave front side and a backpack frame convex back side, the backpack frame comprising: (a) a common point; (b) a first top-end segment and a second top-end segment, the first and second top-end segments extending above the common point and are mirrored images of each other and are separated from each other equidistantly with respect to a vertical central axis of the backpack frame; (c) a first stabilizing paddle and a second stabilizing paddle, the first and second stabilizing paddles in the vicinity of and extending below the common point and the first and second top-end segments, the first and second stabilizing paddles mirrored images of each other and are separated from each other equidistantly with respect to the vertical central axis of the backpack frame, each of the first and second stabilizing paddles bending inward in a concave manner along the backpack frame concave front side; (d) a first vertical support member and a second vertical support member, the first and second vertical support members extending below the common point, the first and second top-end segments, and the first and second stabilizing paddles, the first and second vertical support members mirrored images of each other and are separated from each other equidistantly with respect to the vertical central axis of the backpack frame, the first and second vertical support members having a twist and longitudinally concave with respect to the backpack frame concave front side, the first and second vertical support members forming a stabilizing arch with their inside edges and open, distal ends, oriented downwards; and wherein a plurality of interior mounting slot and exterior mounting slot pairs are disposed on each of the first and second vertical support members.

In another embodiment, the present invention provides a backpack frame for use with a backpack, the backpack frame having a backpack frame concave front side and a backpack frame convex back side, the backpack frame comprising: (a) a common point; (b) a first top-end segment and a second top-end segment, the first and second top-end segments extending above the common point and are mirrored images of each other and are separated from each other equidistantly with respect to a vertical central axis of the backpack frame; (c) a first stabilizing paddle and a second stabilizing paddle, the first and second stabilizing paddles in the vicinity of extending below the common point and the first and second top-end segments, the first and second stabilizing paddles mirrored images of each other and are separated from each other equidistantly with respect to the vertical central axis of the backpack frame, each of the first and second stabilizing paddles bending inward in a concave manner along the backpack frame concave front side; (d) a first vertical support member and a second vertical support member, the first and second vertical support members extending below the common point, the first and second top-end segments, and the first and second stabilizing paddles, the first and second vertical support members mirrored images of each other and are separated from each other equidistantly with respect to the vertical central axis of the backpack frame, the first and second vertical support members having a twist and longitudinally concave with respect to the backpack frame concave front side, the first and second vertical support members forming a stabilizing arch with their inside edges and open, distal ends, oriented downwards, wherein a plurality of interior mounting slot and exterior mounting slot pairs are disposed on each of the first and second vertical support members; and (e) a waist belt base, the waist belt base comprising a spacer pocket, an upper flap attached to an upper edge of the spacer pocket, a lower flap attached to a lower edge of the spacer pocket, a first and second opposing mounting straps, and a third and fourth opposing mounting straps, wherein the first and second opposing mounting straps are threaded through a first pair of opposing interior mounting slots, and the third and fourth opposing mounting straps are threaded through a second pair of opposing interior mounting slots.

BRIEF DESCRIPTION OF THE DRAWINGS

The present disclosure, in accordance with one or more various examples, is described in detail with reference to the following figures. The drawings are provided for purposes of illustration only and merely depict examples of the disclosure. These drawings are provided to facilitate the reader's understanding of the disclosure and should not be considered limiting of the breadth, scope, or applicability of the disclosure. It should be noted that for clarity and ease of illustration these drawings are not necessarily made to scale.

DESCRIPTION OF THE PREFERRED EMBODIMENTS

Figure 1A:
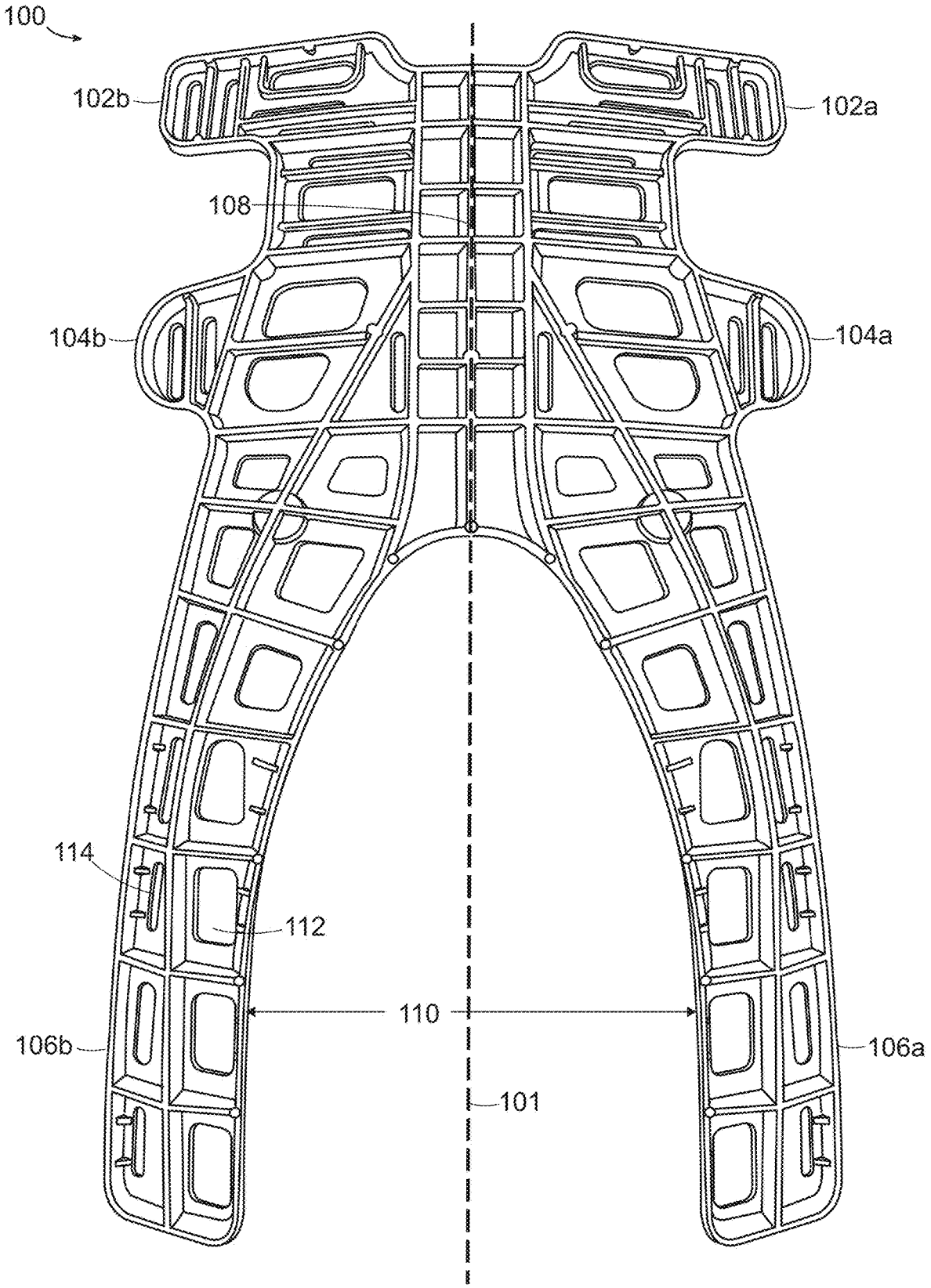
FIGS. 1(A)-(B) illustrate the convex side and concave side of the present invention's frame.

While this invention is illustrated and described in a preferred embodiment, the device may be produced in many different configurations, forms, and materials. There is depicted in the drawings, and will herein be described in detail, a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the present invention.

Figure 1B:
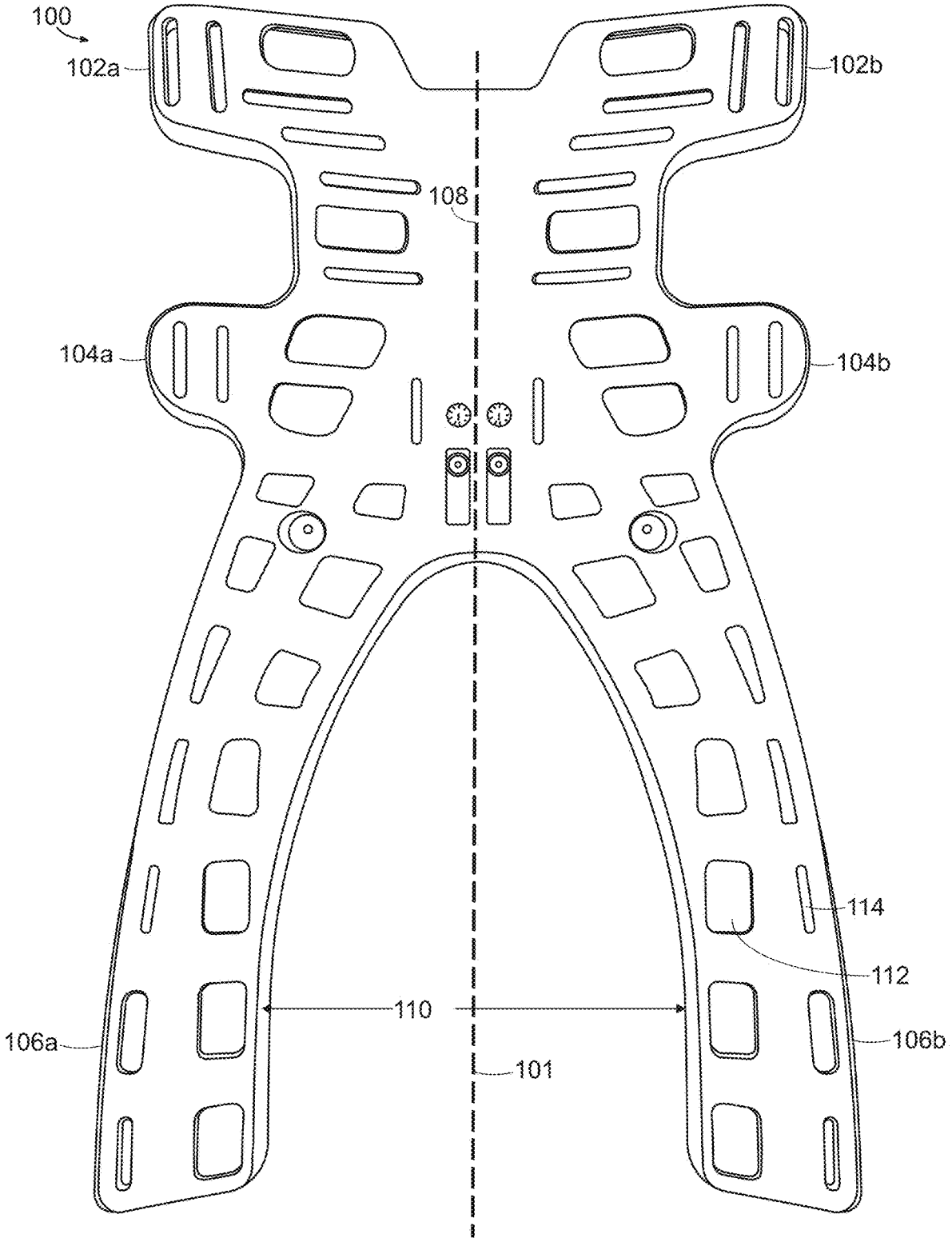

The challenge of improving the comfort, stability, and body armor compatibility of heavily loaded combat backpacks, while reducing weight and expanding the range of body types accommodated, is met by the present invention's articulating frame, as depicted in FIGS. 1(A)-1(B), where the present invention's frame has a convex backside and a concave front side. With reference initially to FIGS. 1(A)-(B), the backpack frame 100, in accordance with the present invention, comprises an integral structure having a "front side" and a "back side." The front side of the frame is a concave structure, whereas the back side of the frame is a convex structure.

In one non-limiting example, the frame may be made from injection-molded thermoplastics. However, other materials such as carbon-fiber composites, wood, or any material with the ability to flex without damage may be used, and such materials are considered within the scope of the invention.

FIG. 1(A) illustrates the convex side of the present invention's frame 100. FIG. 1(B) illustrates the concave side of the present invention's frame. The present invention's unitary-piece frame 100 comprises a pair of top-end segments 102*a-b*, a pair of stabilizing paddles 104*a-b*, and a pair of vertical support members 106*a-b*. As can be seen from FIG. 1(A), each top-end segment, i.e., 102*a* or 102*b*, is symmetric with each other about the virtual central axis 101. Similarly, each stabilizing paddle, i.e., 104*a-b*, is symmetric with each other about the virtual central axis 101. Lastly, each vertical support member, i.e., 106*a* or 106*b*, is symmetric with each other about the virtual central axis 101.

Frame 200's paired arcing and diverging vertical support members 106*a-b* and stabilizing paddles 104*a-b* project from a common point 108, where common point 108 is located closer to the top of frame 200.

To facilitate load stability, frame 100 employs the above-noted stabilizing paddles 104*a-b* that extend outward from the common point 108 horizontally and generally bend inward along a line of the concavity to stabilize the backpack when worn over body armor or other equipment. That is, the surface of the stabilizing paddles 104*a-b* is continuous as it bends outward from the common point 108 and subsequently bends inward along the line of concavity, wherein the bend in the stabilizing paddles 104*a-b* may be seen by comparing FIG. 1(A) with FIG. 1(B). Stabilizing paddles 104*a-b* resist the tendency of the carried loads to shift side to side as the wearer walks while maximizing space for body armor and other back-born equipment worn under the backpack.

Common point 108 could be located anywhere between the top and middle of the frame to achieve some benefit. In the preferred embodiment, the center of common point 108 is located approximately 20% (of the overall frame length) below the frame top. In one non-limiting example, it is envisioned that the center of the common point may be located between 5% to 30% below the frame top.

Vertical support members 106*a-b* are longitudinally concave relative to the wearer's back and are formed by both curving and a gradually increasing twist progressing downward from common point 108 at or near the top of the ruck. The curve of common point 108 that blends into the front surfaces of the vertical support members 106*a-b* does not precisely match the desired angle at the distal ends of the vertical support members where they locate the sewn belt's attachment points. This mismatch will vary depending on the curve selected for the common point 108's front surface and the desired distal vertical support member end's angle. In the preferred embodiment, the distal vertical support member's ends have a steeper angle of twist than that of the common point 108. Relative to the plane of the wearer's back, an inclination of between 10 degrees and 40 degrees at the distal ends of the vertical support members is beneficial. In the preferred embodiment, this inclination is between 20 and 25 degrees. Generally, it is more useful for the angle of the common point to be less than that of the distal ends of the vertical support members to enhance the stability of the vertical support members. Vertical support members 106*a-b* are mirror images of each other, rotated to further form a latitudinal concavity relative to the wearer's back.

The present invention's vertical support members 106*a-b* define a stabilizing arch 110 with their inside edges, the open, distal ends, oriented downward.

Vertical support members 106*a-b* have a series of paired interior mounting slot/exterior mounting slot combinations (e.g., interior mounting slot 112/exterior mounting slot 114 combinations). In one non-limiting example, the interior mounting slot 112 or the exterior mounting slot 114 may be sized to receive standard 1"-1½" webbing. In the preferred embodiment, the interior mounting slot 112 is larger than the exterior mounting slot 114 to accommodate the generally more robust straps needed for securing the waist belt while leaving room for other straps to be secured there. However, the interior mounting slot 112 does not have to be bigger than the exterior mounting slot 114. It should be noted that for convenience, only one pair of internal mounting slot 112/exterior mounting slot 114 are labeled in FIG. 1(B). It should be noted that there are numerous other pairs of internal mounting slot/exterior mounting slot combinations that are available as well in the vertical support members 106*a-b*.

Figure 2A:
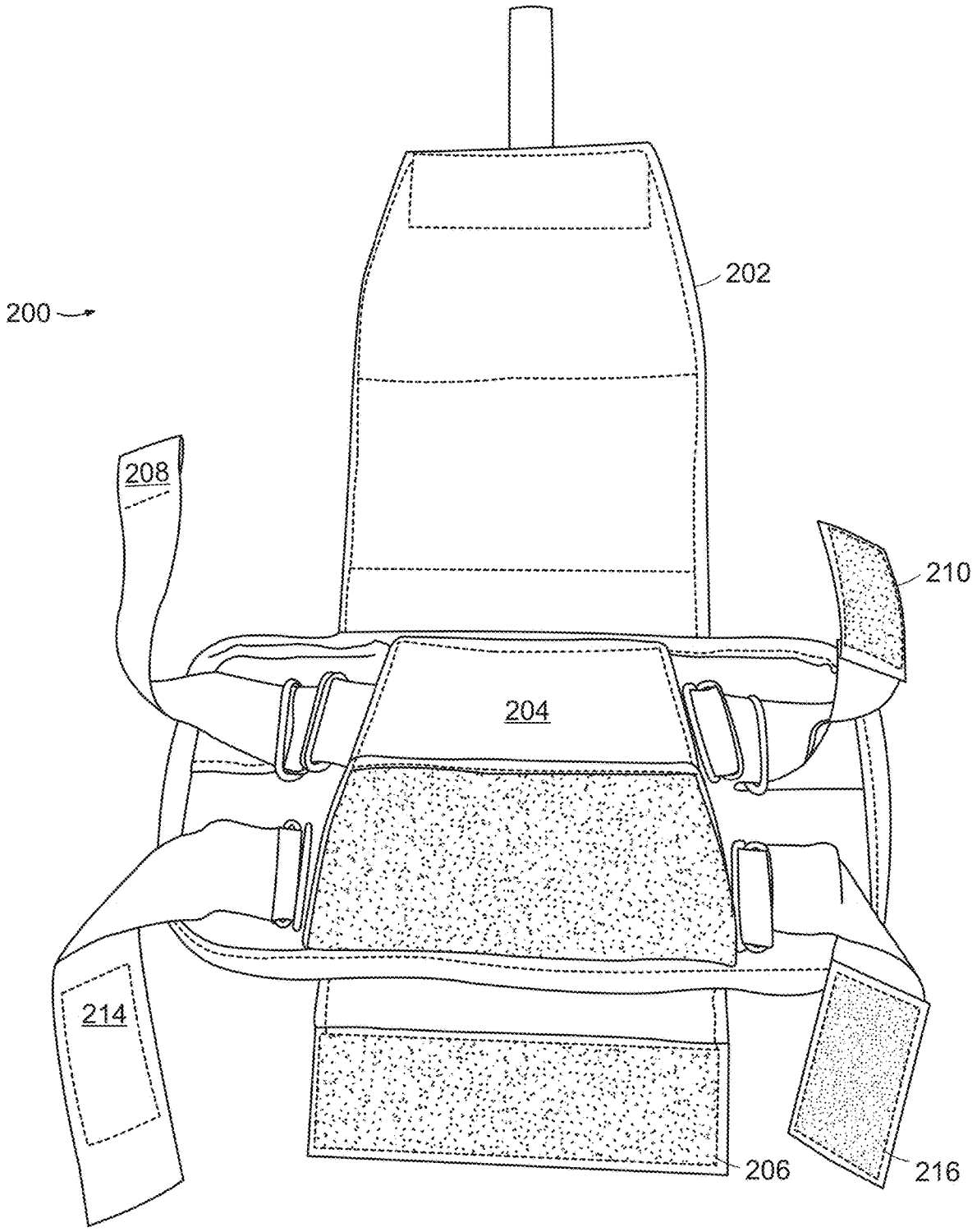
FIGS. 2(A)-(B) illustrate the waist belt base of the present invention.

FIG. 2(A) depicts a waist belt base 200 that may be used with the frame 100 of the present invention. Non-limiting examples of material the waist belt base 200 may be made from include, but are not limited to, fabric, polyethylene (poly) sheets, or closed-cell foam. Waist belt base 200 comprises an upper flap 202, a spacer pocket 204, a lower flap 206, and four mounting straps 208, 210, 214, and 216. Mounting straps 208 and 210 may have thereon fastening mechanisms to enable mounting strap 208 to be fastened to mounting strap 210. For example, mounting straps 208 and 210 may have a complementary hook and loop fastener mechanism that allows mounting strap 208 to be fastened to mounting strap 210. Similarly, mounting straps 214 and 216 may have a complementary fastening mechanism that allows mounting strap 214 to be fastened to mounting strap 216. Non-limiting examples of fastening mechanisms include webbing, a quick-release mechanism, tensioning hardware, a dot snap fastener, metal bales, or a hook-and-loop mechanism such as Velcro™.

In one embodiment, each strap is directly attached to the frame at that point, not tensioning between the opposing straps. FIG. 3(B) is the embodiment with the four attachment points tensioned independently utilizing pairs of metal bales with the excess lengths of strap laid against the belt base and held neatly in place with hook and loop (e.g., Velcro). In an alternate embodiment, the mounting method uses only two pairs of metal bales that tension horizontally across the belt base to the strap on the opposite side.

Figure 2B:
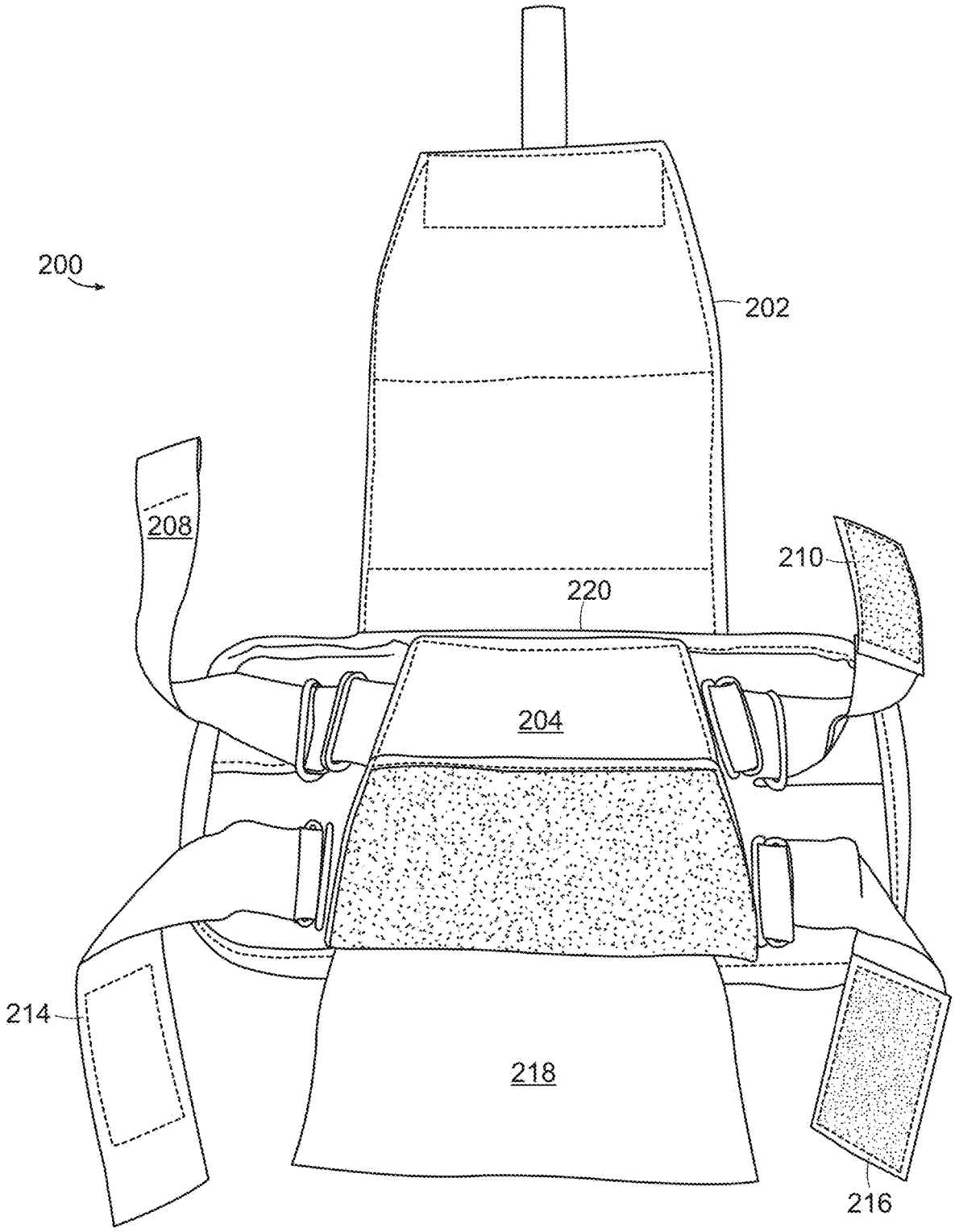

Waist belt base 200 incorporating spacer pocket 204 receives a flexible spacer block 218, as shown in FIG. 2(B), where the flexible spacer block 218 nests inside of, and against, the vertical walls of the stabilizing arch 110. In the preferred embodiment, the spacer block is made from closed-cell foam material due to its light weight, generally rigid, yet resilient properties. However, any material capable of supporting loads across the vertical support members may be used. Non-limiting examples include rubber, wood, composites, etc. Spacer block 218 provides compressive stability to the vertical support members 106*a-b* of frame 100 while it also lends the waist belt base 200 tensile support as frame 100 flexes under heavy loads. The arrangement also permits the waist belt to flex naturally around the wearer's waist, distributing pressure uniformly without the need to tension the belt between stanchions like the prior art.

By tapering the top of the spacer pocket 204/spacer block 218 inward and utilizing the opposing pairs of interior mounting slots, a wide range of vertical waist belt placements are possible to better accommodate variations of body types.

Upper flap 202 is attached at the upper edge 220 in the waist belt base 200, and lower flap 206 is attached at the lower edge 222 of the waist belt base 200, where the lower flap 206 may be folded to cover the spacer pocket 204, and the upper flap 202 may be subsequently folded on top of spacer pocket 204 and lower flap 206, and wrapped around a back side of the spacer pocket 204 (as depicted in FIG. 3(B)). In one non-limiting example, the upper flap 202 is sewn to the upper edge 220. However, it should be noted that how the upper flap 202 is attached to the upper edge 220 should not be used to limit the scope of the present invention. Upper flap 202 and lower flap 206 cover the open end of spacer pocket 204 to retain spacer block 218.

The plurality of interior mounting slots allows the waist belt base 200's vertical location to be adjusted over a wide range without conflicting with the attachment of the ruck and other accessories to the exterior mounting slots.

Figure 4A:
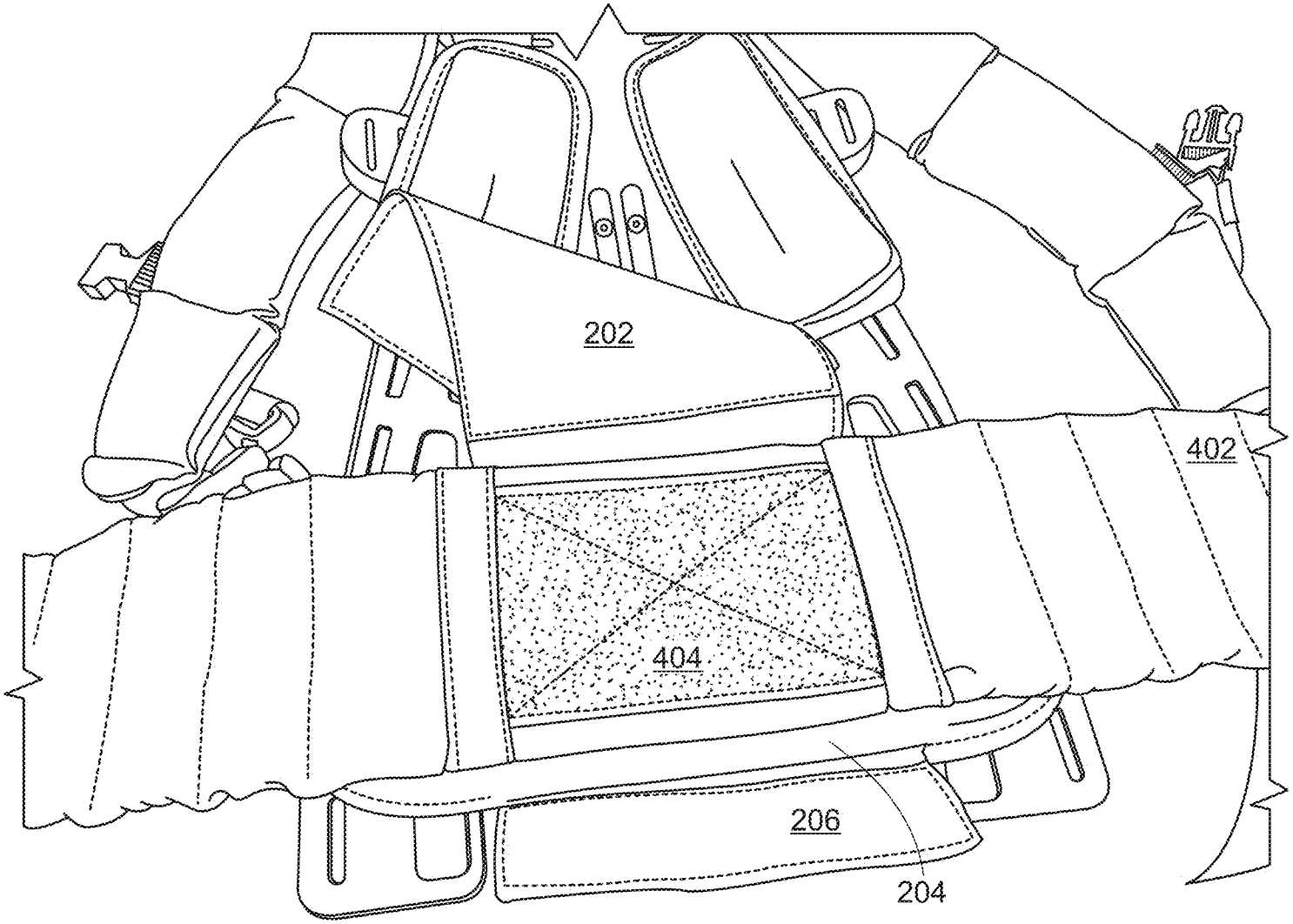
FIGS. 4(A)-(B) illustrate the present invention's embodiment for retaining a removable waist belt in the frame depicted in FIGS. 1(A)-(B).
Figure 4B:
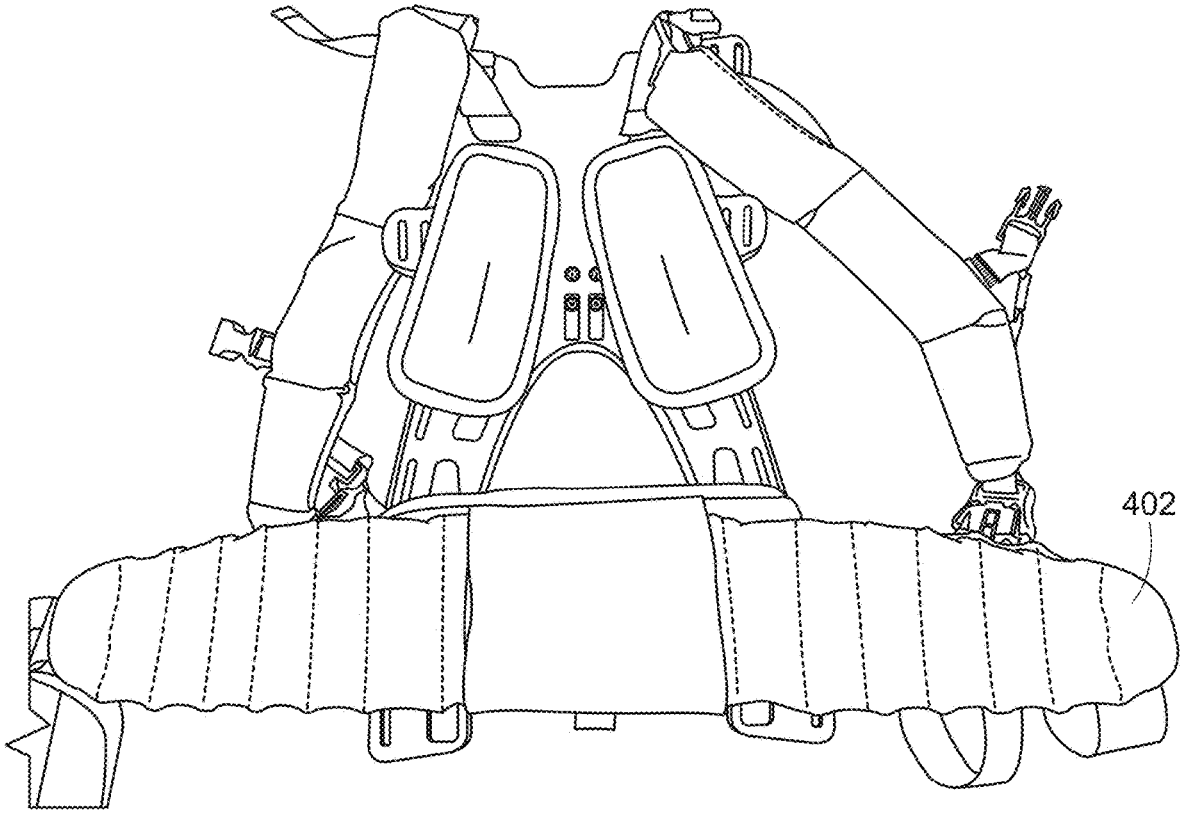

In one embodiment, these overlapping flaps (i.e., overlapping upper flap 202 and lower flap 206) are used to capture a waist belt by folding them over the center of a removable waist belt. FIGS. 4(A)-(B) illustrate this embodiment for retaining waist belt 402. FIG. 4(A) depicts the front side of the present invention's frame with waist belt 402 that is about to be secured. Waist belt 402 has a belt center 404 that is placed on top of spacer pocket 204, as shown in FIG. 4(A), where the belt center 404 has a securement mechanism, such as (but not limited to) a hook and loop fastening mechanism. To secure the waist belt 402, the lower flap 206 folded onto the belt center 404 (where complementary fastening mechanisms, e.g., hook and loop fastening mechanisms, retain the lower flap 206 to a portion of the belt center 404) and, subsequently, the upper flap 202 is folder over the belt center 404 (where complementary fastening mechanisms, e.g., hook and loop fastening mechanisms, retain a portion of the upper flap 202 to another portion of belt center 404), and the lower flap 206, and around to the back side of the spacer pocket 204. The fully installed waist belt is shown in FIG. 4(B).

Spacer block 218 provides both tensile and compressive structural stability to the frame's vertical support members 106*a-b*, yet allows the waist belt base 200, and optionally attached belt 402, to flex around the wearer's waist to distribute pressure evenly over its length without the tendency to roll its bottom edge when under heavy loads.

Mounting straps 208, 210, 212, and 214 thread through the interior mounting slots to secure the waist belt base 200 to vertical support members 106*a-b*. When waist belt base 200 is mounted on frame 100, the waist belt base 200 does not encumber the exterior mounting slots, leaving them for attaching straps associated with the shoulder straps, rucksack, and/or other accessories.

Figure 3A:
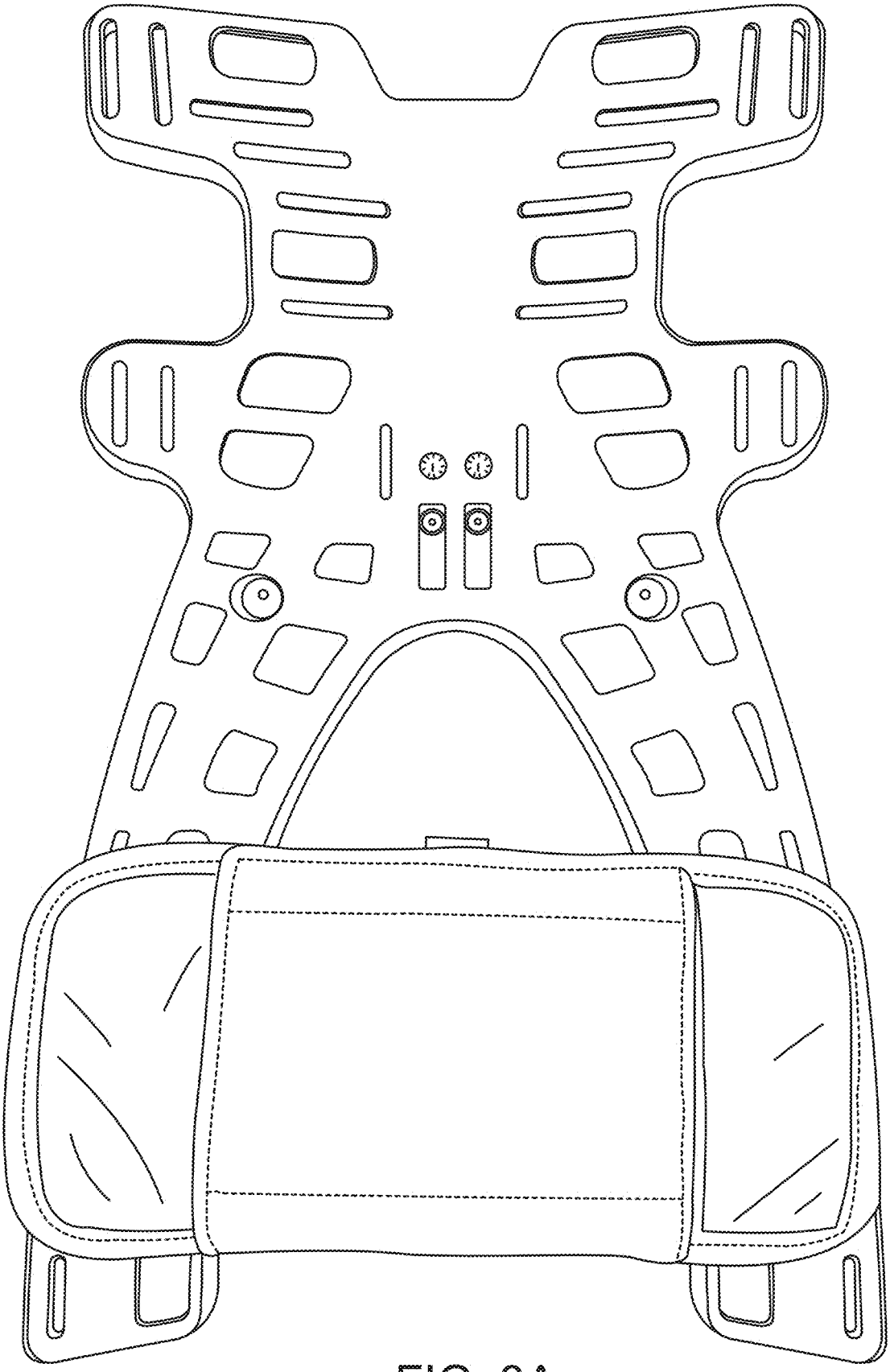
FIGS. 3(A)-(B) illustrate the front side and back side view of the frame with the waist belt base mounted thereon.
Figure 3B:
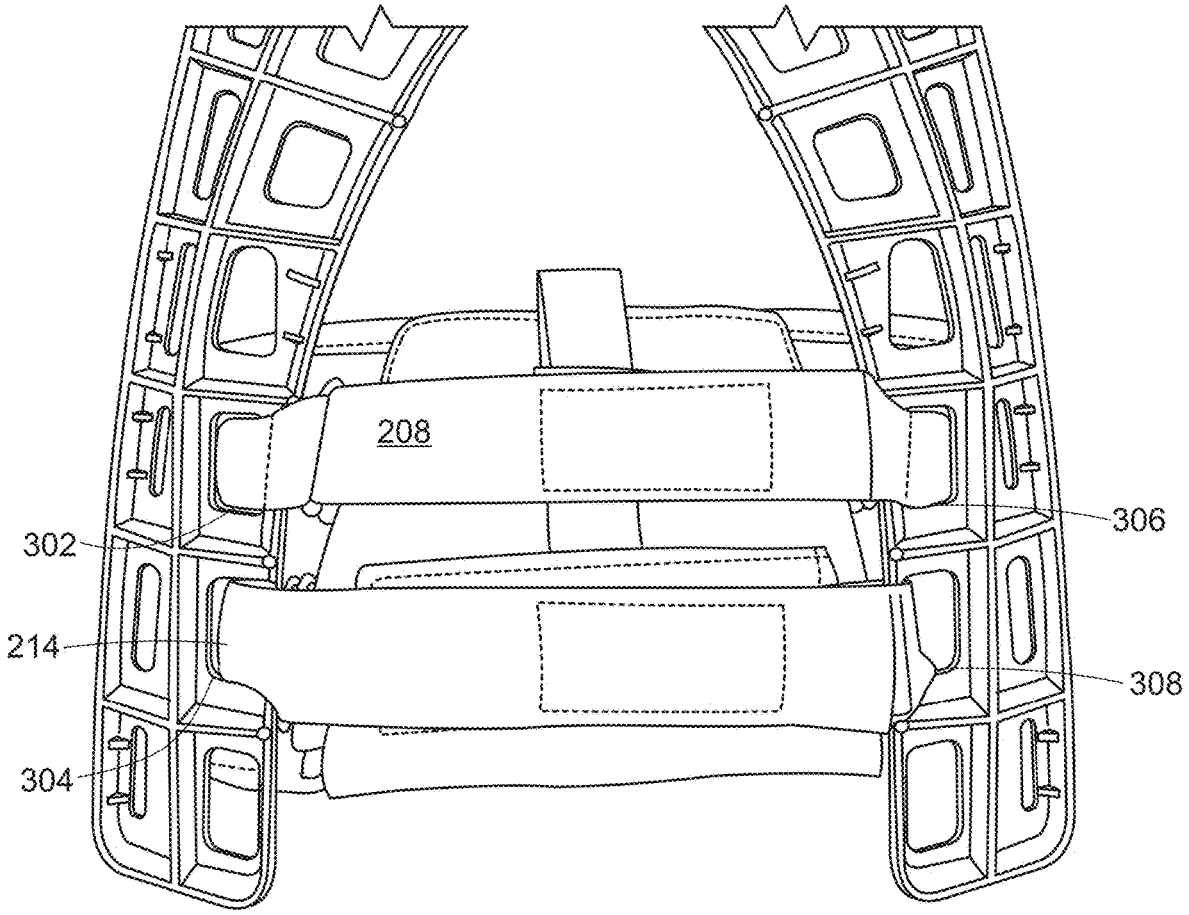

FIG. 3(A) depicts the front side view of the frame with the waist belt base mounted, and FIG. 3(B) depicts the back side view of the frame with the same waist belt base mounted. As can be seen in FIG. 3(B), mounting strap 208 is threaded through interior mounting slot 302 and mounting strap 210 (not shown, as it is underneath mounting strap 210) is threaded through interior mounting slot 306. Similarly, mounting strap 214 is threaded through interior mounting slot 304 and mounting strap 216 (not shown, as it is underneath mounting strap 214) is threaded through interior mounting slot 308.

Figure 5A:
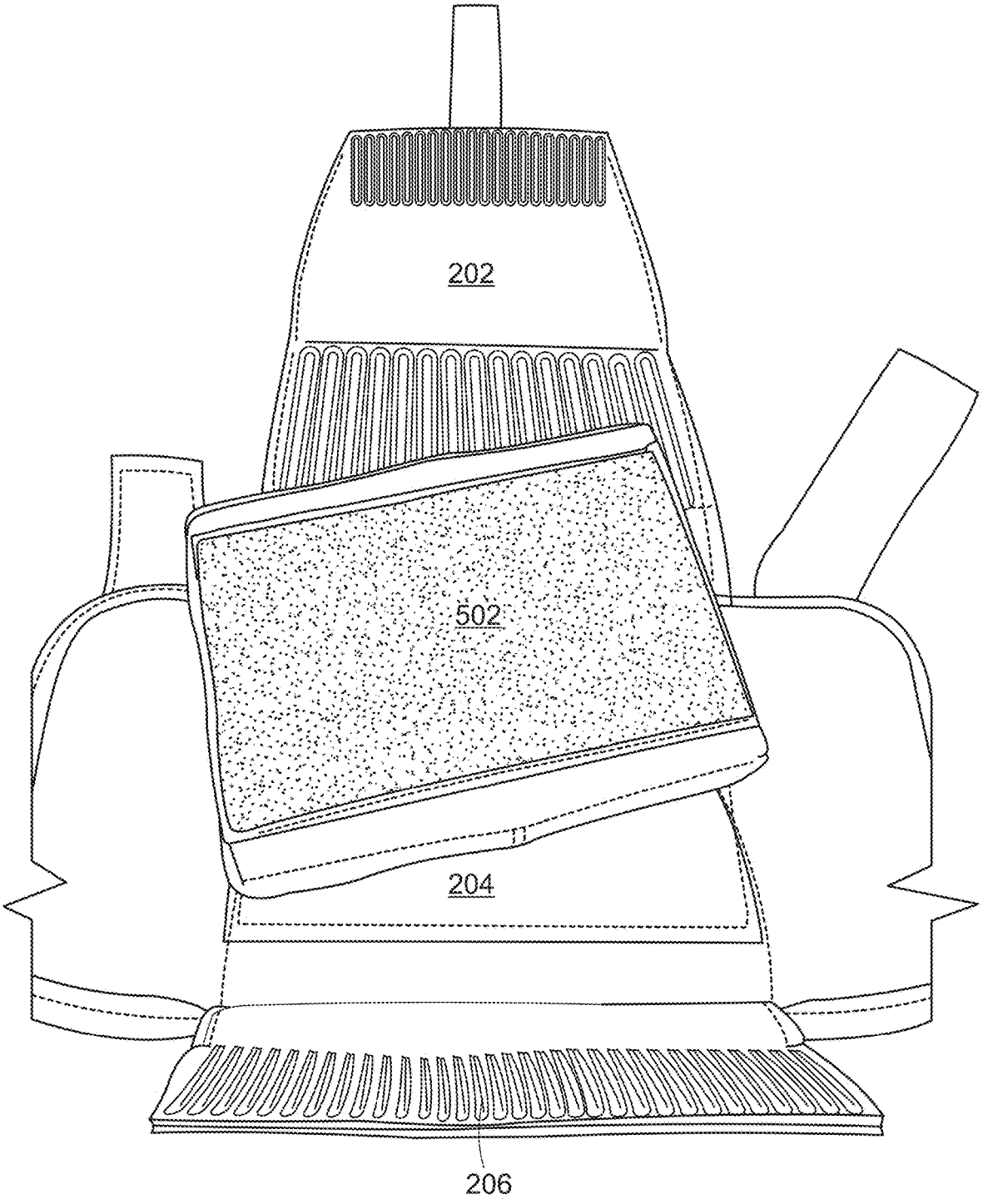
FIGS. 5(A)-(B) depict the present invention's embodiment for retaining a spacer pillow.
Figure 5B:
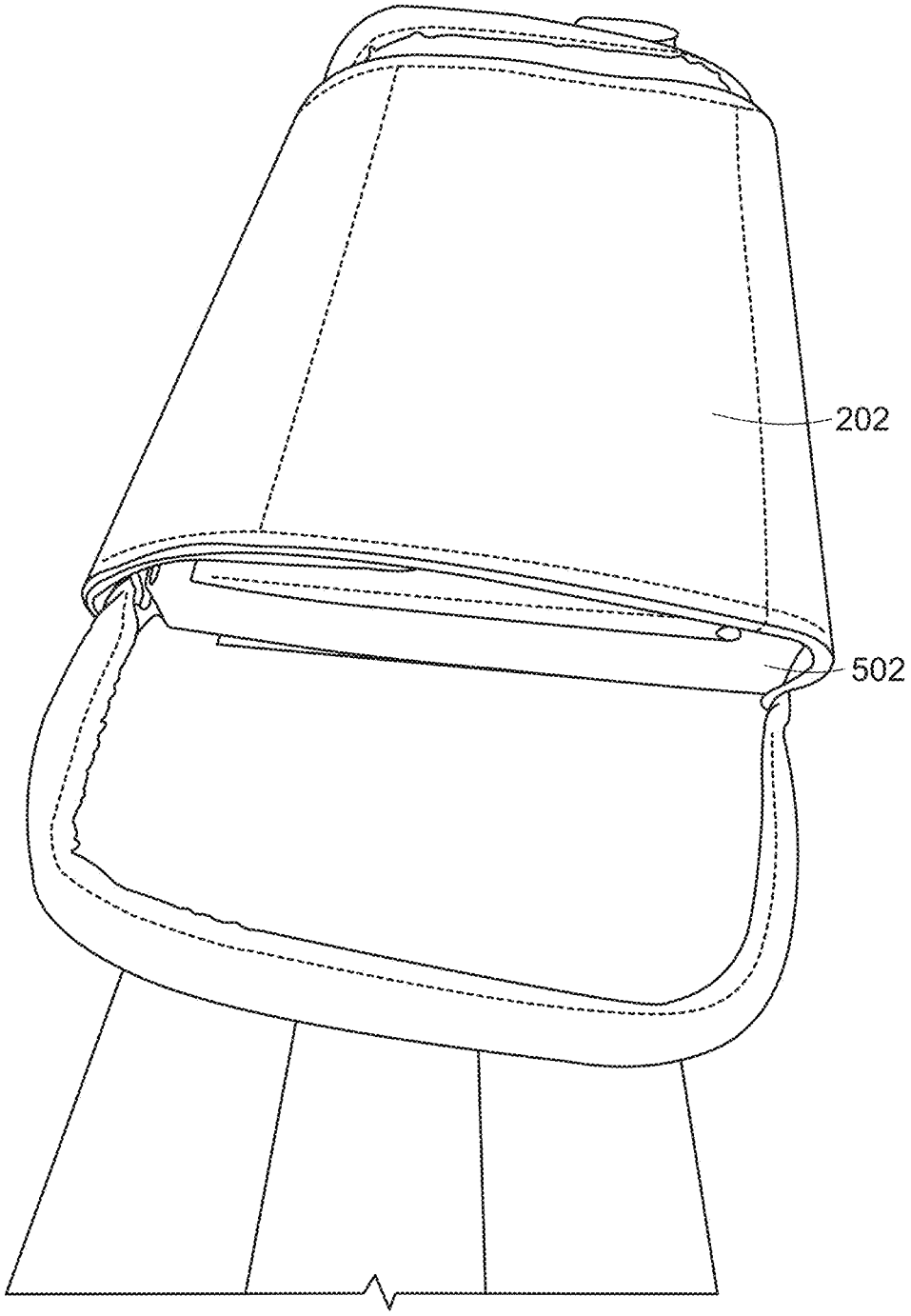

FIGS. 5(A)-(B) depict another embodiment where a spacer pillow 502 can be placed between the waist belt base (and, optionally, the belt center 404 described above with regards to FIGS. 4(A)-(B)) and captured by the folded flaps for additional fitting options. Spacer pillow 502 is placed on top of spacer pocket 204, as shown in FIG. 5(A) and centered, where spacer pillow 502 has a securement mechanism, such as (but not limited to) a hook and loop fastening mechanism. To secure spacer pillow 502, the lower flap 206 folded onto a portion of spacer pillow 502 (where complementary fastening mechanisms, e.g., hook and loop fastening mechanisms, retain the lower flap 206 to a portion of spacer pillow 502) and, subsequently, the upper flap 202 is folder over spacer pillow 502 (where complementary fastening mechanisms, e.g., hook and loop fastening mechanisms, retain a portion of the upper flap 202 to another portion of spacer pillow 502), and the lower flap 206, and around to the back side of the spacer pocket 204. The fully installed spacer pillow is shown in FIG. 5(B).

Spacer pillow 502 modifies the distance that frame 100 is positioned away from the wearer's back, and, accordingly, may be used to optimize comfort for various body types and to optimize the carried load's center of gravity.

As described above, foldable upper and lower flaps 202 and 206, respectively, capture spacer block 218 in its spacer pocket and also allow the rapid attachment of modular special-purpose belts, such as belt 402.

Optionally, the user may use the removable waist belt 402 attached to the waist belt base 200 to carry essential items and support the backpack (i.e., on the user's back), or the user may reconfigure the two separately if the need to drop the backpack due to emerging dangers is anticipated (where the user may now only use the removable waist belt 402). In such situations, foldable upper and lower flaps 202 and 206 also capture items such as the spacer pillow 502 when used.

CONCLUSION

A system and method have been shown in the above embodiments for the effective implementation of an arch pack frame and suspension system. While various preferred embodiments have been shown and described, it will be understood that there is no intent to limit the invention by such disclosure, but rather, it is intended to cover all modifications falling within the spirit and scope of the invention, as defined in the appended claims. For example, the present invention should not be limited by size, materials, or specific manufacturing techniques.

The invention claimed is:

1. A backpack frame for use with a backpack, the backpack frame having a backpack frame concave front side and a backpack frame convex back side, the backpack frame comprising:

(a) a common point;

(b) a first top-end segment and a second top-end segment, the first and second top-end segments extending above the common point and are mirrored images of each other and are separated from each other equidistantly with respect to a vertical central axis of the backpack frame;

(c) a first stabilizing paddle and a second stabilizing paddle, the first and second stabilizing paddles in a vicinity of and extending below the common point and the first and second top-end segments, the first and second stabilizing paddles mirrored images of each other and are separated from each other equidistantly with respect to the vertical central axis of the backpack frame, each of the first and second stabilizing paddles bending inward in a concave manner along the backpack frame concave front side;

(d) a first vertical support member and a second vertical support member, the first and second vertical support members extending below the common point, the first and second top-end segments, and the first and second stabilizing paddles, the first and second vertical support members mirrored images of each other and are separated from each other equidistantly with respect to the vertical central axis of the backpack frame, the first and second vertical support members having a twist and longitudinally concave with respect to the backpack frame concave front side, the first and second vertical support members forming a stabilizing arch with their inside edges and open, distal ends, oriented downwards; and wherein a plurality of interior mounting slot and exterior mounting slot pairs are disposed on each of the first and second vertical support members.

2. The backpack frame of claim 1, wherein the first and second stabilizing paddles resist carried loads shifting from side-to-side of the backpack frame.

3. The backpack frame of claim 1, wherein each interior mounting slot and exterior mounting slot pair comprises an interior mounting slot and an exterior mounting slot arranged in a side-by-side manner.

4. The backpack frame of claim 1, wherein a center of the common point is picked to be located between 20%-30% of an overall frame length of the backpack frame below a top of the backpack frame.

5. The backpack frame of claim 1, wherein the frame is made from injection molded thermoplastics.

6. The backpack frame of claim 1, wherein the backpack frame further comprises a waist belt base, the waist belt base comprising a spacer pocket, an upper flap attached to an upper edge of the spacer pocket, a lower flap attached to a lower edge of the spacer pocket, a first and second opposing mounting straps, and a third and fourth opposing mounting straps, wherein the first and second opposing mounting straps are threaded through a first pair of opposing interior mounting slots, and the third and fourth opposing mounting straps are threaded through a second pair of opposing interior mounting slots.

7. The backpack frame of claim 6, wherein the backpack frame further comprises a spacer block stored in the spacer pocket, wherein the spacer block configured to provide compressive stability to the first and second vertical support members and tensile support to the waist belt base when the backpack frame flexes under heavy loads.

8. The backpack frame of claim 7, wherein the lower flap is folded to cover the spacer pocket, the upper flap is folded on top of the spacer pocket and the lower flap and wrapped around a back side of the spacer pocket, wherein the folded upper and lower flaps cover the spacer pocket retaining the spacer block.

9. The backpack frame of claim 8, wherein the backpack frame further comprises a removable waist belt, wherein a belt center of the removable waist belt is secured on top of the spacer pocket, wherein the lower flap is folded on top of the belt center, the upper flap is folder over the belt center and the lower flap and around to a back side of the spacer pocket.

10. The backpack frame of claim 9, wherein the belt center is secured on top of the spacer pocket via a hook and loop fastening mechanism.

11. The backpack frame of claim 9, the lower flap is secured to a portion of the belt center via a hook and loop fastening mechanism.

12. The backpack frame of claim 11, wherein a portion of the upper flap is secured to another portion of the belt center via a hook and loop fastening mechanism.

13. The backpack frame of claim 9, wherein the spacer block is configured to permit the removable waist belt to flex naturally around a wearer's waist, distributing pressure uniformly without a need to tension the waist belt.

14. The backpack frame of claim 9, wherein the waist belt base and the removable waist belt are made from fabric.

15. The backpack frame of claim 7, wherein the backpack frame further comprises a spacer pillow, wherein the spacer pillow is secured on top of the spacer pocket, wherein the lower flap is folded on top of the spacer pillow, the upper flap is folder over the spacer pillow and the lower flap and around to a back side of the spacer pocket.

16. A backpack frame for use with a backpack, the backpack frame having a backpack frame concave front side and a backpack frame convex back side, the backpack frame comprising:

(a) a common point;

(b) a first top-end segment and a second top-end segment, the first and second top-end segments extending above the common point and are mirrored images of each other and are separated from each other equidistantly with respect to a vertical central axis of the backpack frame;

(c) a first stabilizing paddle and a second stabilizing paddle, the first and second stabilizing paddles in a vicinity of and extending below the common point and the first and second top-end segments, the first and second stabilizing paddles mirrored images of each other and are separated from each other equidistantly with respect to the vertical central axis of the backpack frame, each of the first and second stabilizing paddles bending inward in a concave manner along the backpack frame concave front side;

(d) a first vertical support member and a second vertical support member, the first and second vertical support members extending below the common point, the first and second top-end segments, and the first and second stabilizing paddles, the first and second vertical support members mirrored images of each other and are separated from each other equidistantly with respect to the vertical central axis of the backpack frame, the first and second vertical support members having a twist and longitudinally concave with respect to the backpack frame concave front side, the first and second vertical support members forming a stabilizing arch with their inside edges and open, distal ends, oriented downwards, wherein a plurality of interior mounting slot and exterior mounting slot pairs are disposed on each of the first and second vertical support members; and (e) a waist belt base, the waist belt base comprising a spacer pocket, an upper flap attached to an upper edge of the spacer pocket, a lower flap attached to a lower edge of the spacer pocket, a first and second opposing mounting straps, and a third and fourth opposing mounting straps, wherein the first and second opposing mounting straps are threaded through a first pair of opposing interior mounting slots, and the third and fourth opposing mounting straps are threaded through a second pair of opposing interior mounting slots.

17. The backpack frame of claim 16, wherein the backpack frame further comprises a spacer block stored in the spacer pocket, wherein the spacer block configured to provide compressive stability to the first and second vertical support members and tensile support to the waist belt base when the backpack frame flexes under heavy loads.

18. The backpack frame of claim 17, wherein the lower flap is folded to cover the spacer pocket, the upper flap is folded on top of the spacer pocket and the lower flap and wrapped around a back side of the spacer pocket, wherein the folded upper and lower flaps cover the spacer pocket retaining the spacer block.

19. The backpack frame of claim 18, wherein the backpack frame further comprises a removable waist belt, wherein a belt center of the removable waist belt is secured on top of the spacer pocket, wherein the lower flap is folded on top of the belt center, the upper flap is folder over the belt center and the lower flap and around to a back side of the spacer pocket.

20. The backpack frame of claim 19, wherein the belt center is secured on top of the spacer pocket via a hook and loop fastening mechanism.

21. The backpack frame of claim 19, the lower flap is secured to a portion of the belt center via a hook and loop fastening mechanism.

22. The backpack frame of claim 21, wherein a portion of the upper flap is secured to another portion of the belt center via a hook and loop fastening mechanism.

23. The backpack frame of claim 19, wherein the spacer block is configured to permit the removable waist belt to flex naturally around a wearer's waist, distributing pressure uniformly without a need to tension the waist belt.

24. The backpack frame of claim 19, wherein the waist belt base and the removable waist belt are made from fabric.

25. The backpack frame of claim 17, wherein the backpack frame further comprises a spacer pillow, wherein the spacer pillow is secured on top of the spacer pocket, wherein the lower flap is folded on top of the spacer pillow, the upper flap is folder over the spacer pillow and the lower flap and around to a back side of the spacer pocket.

* * * * *